United States Patent [19]

Kato

[11] Patent Number: 4,491,702

[45] Date of Patent: Jan. 1, 1985

[54] KEY-TOP PANEL AND KEYBOARD STRUCTURE USING THE PANEL

[75] Inventor: Yoshinobu Kato, Sagamihara, Japan

[73] Assignee: Sun Arrow Koeki Company Ltd., Tokyo, Japan

[21] Appl. No.: 374,174

[22] Filed: May 3, 1982

[30] Foreign Application Priority Data

Feb. 1, 1982 [JP] Japan ..... 57-12670

[51] Int. Cl.[3] ..... H01H 13/70

[52] U.S. Cl. ..... 200/5 A; 200/159 B; 200/340

[58] Field of Search ..... 200/5 R, 5 A, 159 B, 200/294, 295, 308, 329, 330, 340; 235/145 R

[56] References Cited

U.S. PATENT DOCUMENTS

| | | | |
|---|---|---|---|
| 3,617,660 | 11/1971 | Krakinowski | 200/340 X |
| 3,760,137 | 9/1973 | Shimojo et al. | 200/5 A X |
| 3,932,722 | 1/1976 | Obata et al. | 200/340 |
| 3,971,902 | 7/1976 | Wulf et al. | 200/5 A |
| 4,127,752 | 11/1978 | Lowthorp | 200/5 A |
| 4,237,351 | 12/1980 | Boulanger et al. | 200/294 X |
| 4,293,754 | 10/1981 | Komaki | 200/5 A X |

*Primary Examiner*—J. R. Scott

*Attorney, Agent, or Firm*—Martin Smolowitz

[57] ABSTRACT

A key-top panel constructed of an electrically non-conductive, resilient material and formed with closed-loop grooves each of which has a closed-loop cross section, each of the closed-loop grooves being deep in the direction of thickness of the key-top panel and having a land portion surrounded by the groove; key-top portions each constituted by the land portion; concavities which are open at the inner face of the key-top panel and which are in registry in cross section with the key-top portions, respectively; and skirt portions each formed between each of the closed-loop grooves and each of the concavities so that the key-top portion surrounded by each closed-loop groove is bridged to an inner wall portion of the key-top panel through each of the skirt portions. The key-top panel may form part of a keyboard structure which may further comprise movable contact elements respectively positioned within the concavities and each fixedly attached to the aforesaid inner end surface portion of each key-top portion.

33 Claims, 3 Drawing Figures

KEY-TOP PANEL AND KEYBOARD STRUCTURE USING THE PANEL

FIELD OF THE INVENTION

The present invention relates to a keyboard structure for use in or as a signal input device such as a keyboard of an electric or electronic appliance, equipment or instrument such as, for example, a computer system, an electronic calculator, or a typewriter, word processor, telex printer, facsimile transmitter of the type having a built-in computer. The present invention is further concerned with a key-top panel to form part of such a keyboard structure.

BACKGROUND OF THE INVENTION

A known key-top panel used in a conventional keyboard structure consists of a thin flat layer of an electrically non-conductive material and a plurality of key-top portions protruding from the outer face of the layer and each having an elastic contact element attached to the internal surface of the key-top portion. A typical example of such a key-top panel is taught in Japanese Utility Model Application No. 56-91636. Since the individual key-top portions of the prior-art key-top panel disclosed therein thus protrude from the outer face of the flat layer, the key-top portions tend to be sidewise contacted, pressed or struck by any parts or structures positioned in the neighborhood of the key-top panel or by operator's fingers during assemblage of the keyboard structure or when the keyboard structure having the key-top panel incorporated therein is in use. If the key-top portions are thus contacted, pressed or struck by such members or structures during assemblage of the keyboard structure, the key-top portions of the panel may be scratched or otherwise damaged and might critically impair the external appearances and accordingly the commercial values of the key-top panel and accordingly the keyboard structure.

Because, furthermore, of the fact that the key-top portions of the key-top panel have rounded or otherwise protuberant end surfaces, extra steps are required to have the individual key-top portions temporarily flattened and held in fixed positions to be printed or labeled with alphabetic letters, numerals and/or signs indicative of the specific functions or commands allocated to the key-top portions. Special jigs or other tools or implements have been used to perform such steps, requiring extra costs for the production of the key-top panel and accordingly the keyboard structure using such a key-top panel. If it is desired to have a group of key-top panels manufactured in such a manner as to be distinguishable by the difference of colors from another group of key-top panels, materials colored differently from each other must be respectively used for molding the two groups of key-top panels. This is also responsible for the high production costs of prior-art key-top panels and the keyboard structures using the key-top panels.

Since the key-top portions of a known key-top panel protrude from the outer face of the base layer of the key-top panel as above noted, the key-top portions arranged at certain spacings from one another on the base layer must be reliably separated from one another. For this reason, a frame member used to have the key-top panel supported thereon has not only side and cross will portions but internal partition wall portions adapted to have the individual key-top portions isolated from one another. Provision of such partition wall portions results not only in further increased production costs of the key-top panel and accordingly the keyboard structure using the key-top panel but in deterioration in the compactness and water tightness of the frame member and accordingly of the keyboard structure using the frame member.

The present invention contemplates provision of a useful solution to these problems which have thus far been encountered in a prior-art key-top panel and a conventional keyboard structure using such a key-top panel.

SUMMARY OF THE INVENTION

In accordance with one outstanding aspect of the present invention, there is provided a key-top panel constructed of an electrically non-conductive, resilient material and formed with (1) a plurality of closed-loop grooves each of which has a closed-loop cross section, each of the closed-loop grooves being deep in the direction of thickness of the key-top panel and forming a land portion surrounded by the closed-loop groove; (2) a plurality of key-top portions each of which is constituted by the land portion; (3) a plurality of concavities which are open at the inner face of the kev-top panel and which are substantially in registry in cross section with the key-top portions, respectively; and (4) skirt portions each of which is formed between each of the closed-loop grooves and each of the concavities so that the key-top portion surrounded by each of the closed-loop grooves is bridged to an inner wall portion of the key-top panel through each of the skirt portions, each of the skirt portions joining with each of the key-top portions and enabling each of the key-top portions to be elastically deformed a desired distance in the direction of thickness of the key-top panel when the key-top portion is depressed at the outer face thereof inwardly in the above mentioned direction. The key-top panel thus constructed preferably has a substantially flat outer face, in which instance the key-top portions respectively have flat outer faces which are substantially flush with the flat outer face of the key-top panel. In the key-top panel according to the present invention, the depth of each of the closed-loop grooves formed in the panel is, preferably, substantially equal to the sum of the thickness of each of the key-top portions and the height of each of the skirt portions.

In accordance with another outstanding aspect of the present invention, there is provided a keyboard structure comprising a key-top panel member having an inner face and an outer face and constructed of an electrically non-conductive, resilient material, the key-top panel member being formed with (1) a plurality of closed-loop grooves each of which has a closed-loop cross section, each of the closed-loop grooves being deep in the direction of thickness of the key-top panel member and forming a land portion surrounded by the closed-loop groove; (2) a plurality of key-top portions each of which is constituted by the land portion; (3) a plurality of concavities which are open at the inner face of the key-top panel member and which are substantially in registry in cross section with the key-top portions, respectively, each of the key-top portions having an inner end surface portion partially defining each of the concavities in the key-top panel member; and (4) skirt portions each of which is formed between each of the closed-loop grooves and each of the concavities so that the key-top portion surrounded by each of the closed-loop grooves is bridged to an inner wall portion of the key-top panel member through each of the skirt portions, each of the skirt portions joining with each of the key-top portions and enabling each of the key-top portions to be elastically deformed a desired distance in the direction of thickness of the key-top panel member when the key-top portion is depressed at the outer face thereof inwardly in the above mentioned direction. The keyboard structure comprising the key-top panel member thus constructed may further comprise a plurality of movable contact elements which are respectively positioned within the concavities and each of which is fixedly attached to the aforesaid inner end surface portion of each of the key-top portions. The keyboard structure may further comprise, in addition to the above mentioned key-top panel member or in combination with the panel member and the movable contact elements, a base member fixedly attached to the outer face of the key-top panel member and having attached to the inner face thereof a plurality of stationary contact elements distributed substantially in conformity to the distribution of the concavities in the key-top panel member, the movable contact elements being located in alignment with and spaced apart from the stationary contact elements, respectively, on the base member in directions of thickness of the keyboard structure. The base member above mentioned is preferably constituted by a printed circuit board having circuit elements printed on the inner face of the base member, the stationary contact elements forming part of the circuit elements. The keyboard structure according to the present invention may further comprise, in combination with the above mentioned key-top panel member or with any one of the key-top panel members, the movable contact elements and the base member, a frame member which consists of a pair of side frame portions spaced apart in parallel from each other and a pair of cross frame portions spaced apart in parallel from each other substantially at right angles to the side frame portions and each connecting together the side frame portions at the ends of the side and cross frame portions, the key-top panel member being secured to the side and cross frame portion of the frame member.

BRIEF DESCRIPTION OF THE DRAWING

The features and advantages of a keyboard structure according to the present invention and a key-top panel forming part of such a keyboard structure in accordance with the present invention will be more clearly appreciated from the following description taken in conjunction with the accompanying drawing, in which.

DESCRIPTION OF THE PREFERRED EMBODIMENTS

Description will be hereinafter made regarding detailed features of a key-top panel according to the present invention and those of a keyboard structure having such a key-top panel member incorporated therein in accordance with the present invention.

Figure 1:
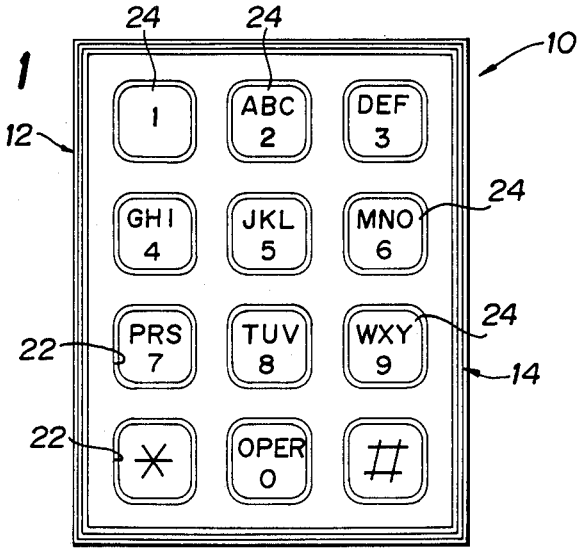
FIG. 1 is a plan view of a preferred embodiment of a keyboard structure according to the present invention and including a key-top panel embodying the present invention.
Figure 2:
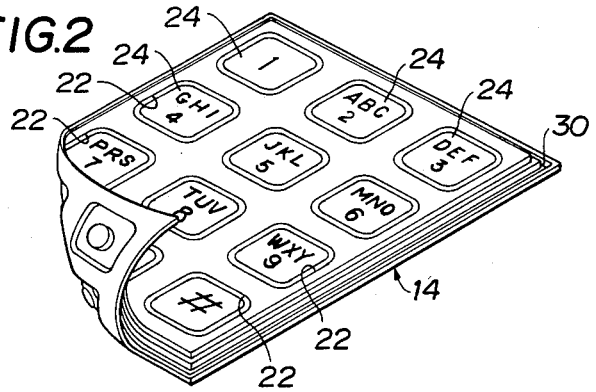
FIG. 2 is a fragmentary perspective view of the key-top panel member forming part of the keyboard structure illustrated in FIG. 1 with a corner portion turned back for ease of understanding of the arrangement on the reverse or inner side of the key-top panel member.

In FIG. 1 of the drawing is shown a keyboard structure embodying the present invention. The keyboard structure, represented by reference numeral 10, not only per se constitutes a preferred embodiment of a keyboard structure according to the present invention but also has incorporated therein a key-top panel embodying the present invention as illustrated in its entirety in FIG. 2 of the drawing. The keyboard structure 10 embodying the present invention is assumed, by way of example, as having a generally rectangular external configuration and comprises a frame member 12 (FIG. 1), and a generally flat key-top panel member 14 (FIG. 2). The keyboard structure 10 comprises a generally flat base plate only a portion of which is indicated at 16 in FIG. 3. The base member 16 is constituted by, for example, a printed circuit board having various circuit elements printed on one or each face thereof as is well known in the art. The base member 16 has an external contour substantially coincident with that of the frame member 12 as will be understood from the partial illustration of FIG. 3.

Figure 3:
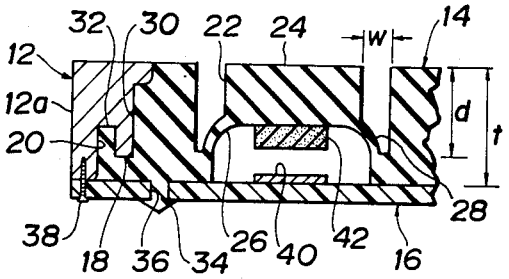
FIG. 3 is a fragmentary cross sectional view of the keyboard structure illustrated in FIG. 1 and including the key-top panel member illustrated in FIG. 2.

The frame member 12 forming part of the keyboard structure 10 embodying the present invention as above mentioned consists of a pair of side frame portions spaced apart in parallel from each other and a pair of cross frame portions spaced apart in parallel from each other substantially at right angles to the side frame portions and each connecting together the side frame portions at the ends of the side and cross frame portions, one of such side and cross frame portions being partially shown in cross section at 12*a* in FIG. 3 of the drawing. As will be best seen from FIG. 3, each of the side and cross frame portions of the frame member 12 has a rib 18 lengthwise extending along each of the frame portions and a closed-loop groove 20 formed adjacent to and also lengthwise extending along each frame portion. The frame member 12 thus shaped may be constructed of any rigid, electrically conductive or non-conductive material such as metal or a hard synthetic resin.

On the other hand, the key-top panel member 14 has a smooth, flat outer face and a generally rectangular external configuration substantially conforming to the internal configuration of the frame member 12 and is constructed of a suitable electrically non-conductive, resilient material such as a synthetic soft rubber or a thermoplastic synthetic resin. The synthetic soft rubber operable for this purpose is silicone rubber, polychloroprene rubber, chloroprene-copolymer rubber, isoprene rubber or butyl rubber, while the thermoplastic synthetic resin may be polyethylene, polypropylene or polyvinyl chloride.

The key-top panel member 14 is formed with a suitable number of closed-loop grooves 22 each of which has a generally rectangular closed-loop cross section as will be seen from FIGS. 1 and 2 in which the key-top panel member 14 is shown having a total of twelve such closed-loop grooves 22 for the purpose of illustration. As will be further seen from the illustration of FIG. 3, each of the closed-loop grooves 22 is deep in the direction of thickness of the key-top panel member 14 and defines a land portion surrounded by the closed-loop groove 22. The land portion thus defined by each of the closed-loop grooves 22 formed in the key-top panel member 14 constitutes each of a plurality of key-top portions 24 which are preferably arranged in predetermined numbers of rows and columns such as, for example, in four rows and three columns as shown in FIGS. 1 and 2 of the drawing. The individual key-top portions 24 respectively have flat outer faces which are substantially flush with the flat outer face of the rest of the key-top panel member 14 as a whole, as will be seen from FIG. 3. As will also be seen from the illustration of FIG. 3, the key-top panel member 14 is further formed with a plurality of concavities 26 which are open at the inner face of the key-top panel member 14 and which are substantially in registry in cross section with the individual key-top portions 24, respectively, of the key-top panel member 14. Thus, each of the key-top portions 24 has an inner end surface portion partially defining each of the concavities 26 in the key-top panel member 14. Furthermore, the key-top panel member 14 has formed between each of the closed-loop grooves 22 and each of the concavities 26 therein a skirt portion 28 through which the key-top portion 24 surrounded by the closed-loop groove 22 is bridged to an inner wall portion of the key-top panel member 14. The skirt portions 28 each formed between each of the closed-loop grooves 22 and each of the concavities 26 in the key-top panel member 14 join with the key-top portions 24, respectively, of the key-top panel member 14 and enable each of the key-top portions 24 to elastically deform a desired distance in the direction of thickness of the key-top panel member 14 when the key-top portion 24 is depressed at the outer face thereof inwardly in the particular direction, viz., in a direction in which the key-top portion 24 is caused to sink from the plane flush with the outer face of the key-top panel member 14 as a whole. As will be best seen from FIG. 3, the key-top panel member 14 is further formed with a closed-loop groove 30 lengthwise extending along each of the two pairs of end walls of the key-top panel member 14 and has a rib portion 32 formed adjacent the closed-loop groove 30 and also lengthwise extending along each of the two pairs of end walls of the key-top panel member 14. The closed-loop grooves 30 and the rib portions 32 thus formed along the two pairs of end walls of the key-top panel member 14 substantially conform in length and cross section to the ribs 18 and closed-loop grooves 20, respectively, of the previously described frame member 12. For the reason that will be understood as the description proceeds, the key-top panel member 14 is further formed with a plurality of hooked lug portions 34 axially protruding at right angles from the inner face of the key-top panel member 14. The key-top portions 24 of the key-top panel member 14 have carried on the outer faces thereof suitable alphabetic letters, numerals and/or signs indicative of the specific functions and/or commands allocated to the key-top portions 24, respectively, as illustrated in FIGS. 1 and 2.

The key-top panel member 14 constructed as described above is prepared by molding any of the above mentioned materials in a suitable die or the like. The thickness (represented by t in FIG. 3) of the key-top panel member 14 thus prepared may vary depending upon the size of each of the key-top portions 24 and the desired number of the key-top portions 24 to be provided therein as well as the desired dimensions, particularly, the width and height of the key-top panel member 14 per se but preferably ranges from about 2 mm to about 8 mm for ordinary purposes. On the other hand, the width and depth (indicated by w and d, respectively, in FIG. 3) of each of the closed-loop grooves 22 formed in the key-top panel member 14 may be selected arbitrarily insofar as the skirt portion 28 joining with each of the key-top portions 24 of the key-top panel member 14 is enabled to elastically deform a desired distance in the direction of thickness of the key-top panel member 14. For compact construction of the key-top panel member 14 as a whole, however, the width w of each of the closed-loop grooves 22 is preferably selected within the range of between about 0.5 mm and 1.5 mm while the depth d of each closed-loop groove 22 is selected to be larger than the thickness of each of the key-top portions 24 and preferably approximately equal to the sum of the thickness of each of the key-top portions 24 and the height of each of the skirt portions 28.

The key-top panel member 14 having the above described configuration is closely attached to the frame member 12 with the ribs 18 of the side and cross frame portions of the frame member 12 respectively received in the closed-loop grooves 30 in the end walls of the key-top panel member 14 and with the rib portions 32 of the end walls of the key-top panel member 14 respectively fitted in the closed-loop grooves 20 in the frame portions of the frame member 12 as partially shown in FIG. 3 of the drawing. Furthermore, the key-top panel member 14 is fixedly attached to the base member 16 with the hooked lug portions 34 of the key-top panel member 14 press fitted respectively through apertures 36 formed in the base member 16 as also shown in FIG. 3. The base member 16 in turn is fixedly attached to the frame member 12 by suitable fastening means such as screws so that the key-top panel member 14 is also secured to the frame member 12, one of such screws being indicated at 38 in FIG. 3. The base member 16 has its inner face held in contact with the reverse or inner face of the key-top panel member 14 and thereby closes the individual concavities 26 formed in the key-top panel member 14 as will be also seen from FIG. 3.

The base member 16 is constituted by a printed circuit board having various circuit elements printed on one or each of the faces thereof as previously described. In the embodiment of the keyboard structure as herein shown, the base member 16 has thus attached to the inner face thereof a plurality of stationary contact elements 40 forming part of such circuit elements, each of the stationary contact elements 40 being herein assumed as being in the form of a thin layer of an electrically conductive material. The stationary contact elements 40 thus carried on the inner face of the base member 16 are distributed substantially in conformity with the distribution of the concavities 26 in the key-top panel member 14. On the other hand, the key-top panel member 14 has a plurality of movable contact elements 42 each of which is bonded or otherwise fixedly attached to the previously mentioned inner end surface portion of each of the key-top portions 24 as shown in FIG. 3. The individual movable contact elements 42 thus carried on the key-top panel member 14 and respectively positioned within the concavities 26 in the key-top panel member 14 are located in alignment with and spaced apart from the above mentioned stationary contact elements 40, respectively, on the base member 16 in directions of thickness of the keyboard structure 10. Each of the movable contact elements 42 is constructed of a suitable electrically conductive and preferably elastic material such as for example carbon-containing silicone rubber.

When each of the key-top portions 24 of the key-top panel member 14 thus constructed are left untoutched by keyboard operator's finger tips or, in other words, allowed to stay in a normal position with its outer face kept flush with the outer face of the key-top panel member 14 as a whole and with the associated skirt portion 28 kept unwarped, each of the movable contact elements 42 attached to the respective inner end faces of the key-top portions 24 is spaced apart from the associated one of the stationary contact elements 40 on the inner face of the base member 16. Under these conditions, each movable contact element 42 is electrically disconnected from the associated stationary contact element 40 on the base member 16. When any one of the key-top portions 24 is depressed by a keyboard operator's finger tip, the particular key-top portion 24 is caused to sink from the normal position thereof toward the inner face of the base member 16 with the skirt portion 28 joining with the key-top portion 24 deformed also toward the inner face of the base member 16 against the elasticity thereof. Under these conditions, the movable contact element 42 attached to the inner end surface portion of the key-top portion 24 thus depressed is moved into contact with the associated one of the stationary contact elements 40 on the inner face of the base member 16 and is electrically connected to the particular stationary contact element 40 on the base member 16.

As will have been understood from the foregoing description, the keyboard structure and accordingly the key-top panel proposed by the present invention are characterized inter alia in that the individual key-top portions of the key-top panel forming part of the keyboard structure have their respective outer faces maintained substantially flush with the outer face of the key-top panel as a whole when held in the normal positions thereof. There thus being no key-top portions protruding from the outer face of the key-top panel as a whole when the key-top portions are held in the normal positions thereof, the key-top portions are protected perfectly from being sidewise contacted, pressed or struck by any members or structures positioned in the neighborhood of the key-top panel during assemblage of the keyboard structure or when the keyboard structure having the key-top panel incorporated therein is in use. Furthermore, because of the fact that the key-top portions of the key-top panel have substantially flat outer faces, the outer end faces of the key-top portions need not be flattened and fixed by the use of jigs or other extra tools or implements which have thus far been required when in printing or labeling the individual key-top portions with letters, numerals and/or signs on the key-top portions of a conventional key-top panel. If it is desired to have a group of key-top panels manufactured in such a manner as to be distinguishable by the difference of colors from another group of key-top panels, the outer face of the key-top panel provided by the present invention can be in part or in its entirety printed in a desired color easily and economically. Likewise, the respective flat outer faces of the key-top portions of the key-top panel can be easily and economically printed in desired colors so as to make each key-top portion distinguishable from the other key-top portions of the key-top panel member by the difference of colors.

The key-top panel and accordingly the keyboard structure proposed by the present invention are further characterized in that the key-top portions of the key-top panel are at all times totally sunk from the plane of the outer face of the key-top panel as a whole and, thus, the key-top panel per se has wall portions serving as partition walls integral with but intervening between the closed-loop grooves respectively surrounding the individual key-top portions of the key-top panel. For this reason, the frame member for use with such a key-top panel need not be provided with internal partition wall portions to have the key-top portions isolated from each other thereacross. Omission of such partition wall portions from the frame member will contribute not only to the saving of the production costs of the key-top panel member and accordingly the keyboard structure using the key-top panel member but improving the compactness and water tightness of the frame member and accordingly of the keyboard structure using the frame member.

What is claimed is:

1. A key-top panel constructed of an electrically non-conductive, resilient material and having substantially flat parallel inner and outer faces and a plurality of closed-loop grooves which are open at the outer face of the panel and each of which has a closed-loop cross section, each of the closed-loop grooves being deep in the direction of thickness of the key-top panel and defining a land portion surrounded by the closed-loop groove, comprising a plurality of key-top portions each of which is constituted by said land portion and surrounded by each of said closed-loop grooves throughout the thickness of the key-top portion; a plurality of concavities which are open at the inner face of the key-top panel and which are substantially in registry in cross section with said key-top portions, respectively; and skirt portions each of which is formed between each of the closed-loop grooves and each of the concavities so that the key-top portion surrounded by each of said closed-loop grooves is bridged to an inner wall portion of the key-top panel through each of said skirt portions, each of the skirt portions joining with each of said key-top portions and enabling each of the key-top portions to be elastically deformed a desired distance in the direction of thickness of the key-top panel when the key-top portion is depressed at the outer face thereof inwardly in said direction, each of said skirt portions extending generally in frusto-conical form between each of said key-top portions and each of peripheral portions of the key-top panel which surrounds the key-top portions, respectively, and the depth of each of said closed-loop grooves being larger than the thickness of each of said key-top portions.

2. A key-top panel as set forth in claim 1, having a substantially flat outer face, said key-top portions respectively having flat outer faces which are substantially flush with the flat outer faces of said peripheral portions of the key-top panel.

3. A key-top panel as set forth in claim 1 or 2, in which each of said skirt portions extends from the inner end of each of said key-top portions and in which the depth of each of said closed-loop grooves is substantially equal to the sum of the thickness of each of said key-top portions and the height of each of said skirt portions.

4. A key-top panel as set forth in claim 1 or 2, in which the width of each of said closed-loop grooves is selected within the range between about 0.5 mm and about 1.5 mm.

5. A key-top panel as set forth in claim 4, in which each of said skirt portions extends from the inner end of each of said key-top portions and in which the depth of each of said closed-loop grooves is substantially equal to the sum of the thickness of each of said key-top portions and the height of each of said skirt portions.

6. A key-top panel as set forth in claim 1 or 2, in which the thickness of said key-top panel is selected within the range between about 2 mm and about 8 mm.

7. A key-top panel as set forth in claim 6, in which the width of each of said closed-loop grooves is selected within the range between about 0.5 mm and about 1.5 mm.

8. A key-top panel as set forth in claim 3, in which the width of each of said closed-loop grooves is selected within the range between about 0.5 mm and about 1.5 mm and in which the thickness of said key-top panel is selected within the range between about 2 mm and about 8 mm.

9. A key-top panel as set forth in claim 3, in which the thickness of said key-top panel is selected within the range between about 2 mm and about 8 mm.

10. A key-top panel as set forth in claim 1 or 2, in which the width of each of said closed-loop grooves is selected within the range between about 0.5 mm and about 1.5 mm and in which the thickness of said key-top panel is selected within the range between about 2 mm and about 8 mm.

11. A key-top panel as set forth in claim 1 or 2, in which said material is synthetic soft rubber selected from the group consisting of silicone rubber, polychloroprene rubber, chloroprene-copolymer rubber, isoprene rubber and butyl rubber.

12. A key-top panel as set forth in claim 1 or 2, in which said material is a synthetic thermoplastic synthetic resin selected from the group consisting of polyethylene, polypropylene and polyvinyl chloride.

13. A key-top panel as set forth in claim 3, in which said material is synthetic soft rubber selected from the group consisting of silicone rubber, polychloroprene rubber, chloroprene-copolymer rubber, isoprene rubber and butyl rubber.

14. A key-top panel as set forth in claim 3, in which said material is a synthetic thermoplastic synthetic resin selected from the group consisting of polyethylene, polypropylene and polyvinyl chloride.

15. A keyboard structure comprising a key-top panel member having an inner face and an outer face and constructed of an electrically non-conductive, resilient material, the key-toop panel member having substantially flat parallel inner and outer faces and a plurality of closed-loop grooves which are open at the outer face of the panel and each of which has a closed-loop cross section, each of the closed-loop grooves being deep in the direction of thickness of the key-top panel member and defining a land portion surrounded by the closed-loop groove, comprising a plurality of key-top portions each of which is constituted by said land portion and surrounded by each of said closed-loop grooves throughout the thickness of the key-top portion; a plurality of concavities which are open at the inner face of the key-top panel member and which are substantially in registry in cross section with said key-top portions, respectively, each of the key-top portions having an inner end surface portion partially defining each of the concavities in the key-top panel member; and skirt portions each of which is formed between each of the closed-loop grooves and each of the concavities so that the key-top portion surrounded by each of said closed-loop grooves is bridged to an inner wall portion of the key-top panel member through each of said skirt portions, each of the skirt portions joining with each of said key-top portions for enabling each of the key-top portions to be elastically deformed a desired distance in the direction of thickness of the key-top panel member when the key-top portion is depressed at the outer face thereof inwardly in said direction, each of said skirt portions extending generally in frusto-conical form between each of said key-top portions and each of peripheral portions of the key-top panel which surround the key-top portions, respectively, the depth of each of said closed-loop grooves being larger than the thickness of each of said key-top portions.

16. A keyboard structure as set forth in claim 15, further comprising a plurality of movable contact elements which are respectively positioned within said concavities and each of which is fixedly attached to said inner end surface portion of each of the key-top portions.

17. A keyboard structure as set forth in claim 16, in which each of said movable contact elements is constructed of an electrically conductive, elastic material.

18. A keyboard structure as set forth in claim 16, further comprising a base member fixedly attached to the inner face of said key-top panel member and having attached to the inner face thereof a plurality of stationary contact elements which are distributed substantially in conformity to the distribution of said concavities in the key-top panel member, said movable contact elements being located substantially in alignment with and spaced apart from said stationary contact elements, respectively, on the base member in directions of thickness of the keyboard structure.

19. A keyboard structure as set forth in claim 18, in which said base member is constituted by a printed circuit board having circuit elements printed on said inner face of the base member, said stationary contact elements forming part of said circuit elements.

20. A keyboard structure as set forth in any one of claims 15 to 19, in which said key-top panel member has a substantially flat outer face, wherein said key-top portions respectively have flat outer faces which are substantially flush with the flat outer faces of said peripheral portions of the key-top panel member.

21. A keyboard structure as set forth in any one of claims 15 to 19, in which each of said skirt portions extends from the inner end of each of said key-top portions and in which the depth of each of said closed-loop grooves is substantially equal to the sum of the thickness of each of said key-top portions and the height of each of said skirt portions.

22. A keyboard structure as set forth in any one of claims 15 to 19, in which the width of each of said closed-loop grooves is selected within the range between about 0.5 mm and about 1.5 mm.

23. A keyboard structure as set forth in any one of claims 15 to 19, in which the thickness of said key-top panel member is selected within the range between about 2 mm and about 8 mm.

24. A keyboard structure as set forth in any one of claims 15 to 19, in which the width of each of said closed-loop grooves is selected within the range between about 0.5 mm and about 1.5 mm and in which the thickness of said key-top panel member is selected within the range between about 2 mm and about 8 mm.

25. A keyboard structure as set forth in any one of claims 15 to 19, in which said material is synthetic soft rubber selected from the group consisting of silicone rubber, polychloroprene rubber, chloroprene-copolymer rubber, isoprene rubber and butyl rubber.

26. A keyboard structure as set forth in any one of claims 15 to 19, in which said material is a synthetic thermoplastic synthetic resin selected from the group consisting of polyethylene, polypropylene and polyvinyl chloride.

27. A keyboard structure as set forth in claim 15, in which said key-top panel member has a substantially flat outer face, said key-top portions respectively have flat outer faces which are substantially flush with the flat outer face of the key-top panel member.

28. A keyboard structure as set forth in claim 15, in which the depth of each of said closed-loop grooves is substantially equal to the sum of the thickness of each of said key-top portions and the height of each of said skirt portions.

29. A keyboard structure as set forth in claim 15, in which the width of each of said closed-loop grooves is selected within the range between about 0.5 mm and about 1.5 mm.

30. A keyboard structure as set forth in claim 15, in which the thickness of said key-top panel member is selected within the range between about 2 mm and about 8 mm.

31. A keyboard structure as set forth in claim 15, in which the width of each of said closed-loop grooves is selected within the range between about 0.5 mm and about b 1.5 mm and in which the thickness of said key-top panel member is selected within the range between about 2 mm and about 8 mm.

32. A keyboard structure as set forth in claim 15, in which said material is synthetic soft rubber selected from the group consisting of silicone rubber, polychloroprene rubber, chloroprene-copolymer rubber, isoprene rubber and butyl rubber.

33. A keyboard structure as set forth in claim 15, in which said material is a synthetic thermoplastic synthetic resin selected from the group consisting of polyethylene, polypropylene and polyvinyl chloride.

* * * * *